US011976554B2

(12) United States Patent
Liu et al.

(10) Patent No.: US 11,976,554 B2
(45) Date of Patent: May 7, 2024

(54) BOTTOM-HOLE IMPACT-ROTATION STEPPING COMBINED UNLOADING ROCK-BREAKING EFFICIENT DRILLING SYSTEM AND METHOD THEREOF

(71) Applicant: CHINA UNIVERSITY OF PETROLEUM (EAST CHINA), Qingdao (CN)

(72) Inventors: Yongwang Liu, Qingdao (CN); Sen Wei, Qingdao (CN); Zhichuan Guan, Qingdao (CN); Deyong Zou, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 17/759,149

(22) PCT Filed: Apr. 1, 2021

(86) PCT No.: PCT/CN2021/084838
§ 371 (c)(1),
(2) Date: Nov. 21, 2023

(87) PCT Pub. No.: WO2022/193373
PCT Pub. Date: Sep. 22, 2022

(65) Prior Publication Data

US 2024/0084646 A1 Mar. 14, 2024

(30) Foreign Application Priority Data

Mar. 17, 2021 (CN) ..... 202110283487.9

(51) Int. Cl.
*E21B 6/06* (2006.01)
*E21B 10/38* (2006.01)

(52) U.S. Cl.
CPC ..... *E21B 6/06* (2013.01); *E21B 10/38* (2013.01)

(58) Field of Classification Search
CPC . E21B 6/06; E21B 10/38; E21B 10/40; E21B 10/02
See application file for complete search history.

(56) References Cited

U.S. PATENT DOCUMENTS 2,547,609 A * 4/1951 Vanderzee ..... E21B 7/02 173/147
2012/0234603 A1* 9/2012 Vail, III ..... E21B 4/02 175/57

(Continued)

FOREIGN PATENT DOCUMENTS

CN 104847259 A 8/2015
CN 109594927 A 4/2019
CN 111894463 A 11/2020

OTHER PUBLICATIONS

Notice of Allowance issued in corresponding Chinese Application No. 202110283487.9; dated Jan. 15, 2022 3 pgs.

(Continued)

*Primary Examiner* — Shane Bomar
(74) *Attorney, Agent, or Firm* — HAUPTMAN HAM, LLP

(57) ABSTRACT

The present invention provides a bottom-hole impact-rotation stepping combined unloading rock-breaking efficient drilling system, including a housing, a drive assembly, a universal joint, a transmission shaft, a rotational impact assembly, and a drill bit; the transmission shaft is connected with the housing; the rotational impact assembly includes a rotational transmission assembly for conveying a rotational power to the drill bit and an impact assembly for providing (Continued)

a high frequency axial impact power to the drill bit; when the rotational transmission assembly rotates along with the transmission shaft, the impact assembly applies a high frequency impact force along a drilling axial direction to the rotational transmission assembly; an annular drill bit is disposed at an outer end of a drill bit body of the drill bit; a central drill bit is slidably disposed on an inner ring end surface of the annular drill bit; an inwardly-recessed cylindrical region is formed between a head end of the annular drill bit and a head end of the central drill bit. The present invention further provides a bottom-hole impact-rotation stepping combined unloading rock-breaking efficient drilling method. In the present invention, with entire structural disposal, stepping rock-breaking, bottom hole unloading and impact-rotation drilling can be achieved at the same time, greatly increasing the rock-breaking drilling efficiency.

8 Claims, 2 Drawing Sheets

(56) References Cited

U.S. PATENT DOCUMENTS

| | | | | |
|---|---|---|---|---|
| 2014/0166368 | A1* | 6/2014 | Guan | E21B 7/18 175/315 |
| 2017/0122033 | A1* | 5/2017 | Vail, III | E21B 4/02 |
| 2018/0363381 | A1* | 12/2018 | Guan | E21B 4/06 |
| 2021/0054694 | A1* | 2/2021 | Bennion | E21B 4/003 |
| 2021/0246729 | A1* | 8/2021 | Liu | E21B 10/04 |

OTHER PUBLICATIONS

First Office Action issued in corresponding Chinese Application No. 202110283487.9; dated Aug. 18, 2021; 12 pgs.

Search Report issued in corresponding Chinese Application No. 202110283487.9; dated Aug. 10, 2021; 5 pgs.

International Search Report and Written Opinion issued in corresponding International Application No. PCT/CN2021/084838; dated Oct. 20, 2021; 16 pgs.

* cited by examiner

BOTTOM-HOLE IMPACT-ROTATION STEPPING COMBINED UNLOADING ROCK-BREAKING EFFICIENT DRILLING SYSTEM AND METHOD THEREOF

RELATED APPLICATIONS

The present application is a U.S. National Phase of International Application Number PCT/CN2021/084838 filed Apr. 1, 2021, and claims priority to Chinese Application Number 202110283487.9 filed Mar. 17, 2021.

TECHNICAL FIELD

The present invention relates to the field of drilling technologies and in particular to a bottom-hole impact-rotation stepping combined unloading rock-breaking efficient drilling system and a method thereof.

BACKGROUND

Improving rock-breaking efficiency has always been a research hotspot of the drilling engineering field, and the most common method of improving the rock-breaking efficiency at present is to increase the rock-breaking capability and service life of a rock-breaking tool and enhance bottom-hole rock-breaking energy. Based on the above method, multiple rock-breaking drilling systems have been formed until now. Practices show that the above systems improve the rock-breaking efficiency to some degree but have not reached an anticipated onsite index. How to further improve the rock-breaking efficiency has become a bottleneck problem for drilling of a hard and difficult-to-drill formation.

A relationship between a rock-breaking tool and a formation during a drilling rock-breaking process may be understood as a relationship of an attacker and a defender in a war in which the rock-breaking tool attacks and the formation defends. Thus, enhancing the continuous rock-breaking capability of the rock-breaking tool can improve the rock-breaking efficiency. If the defense capability of the "defender"—the formation can be destroyed, that is, the drilling resistance of the formation for the rocks is reduced, the rock-breaking efficiency can be certainly improved.

Based on this, the present invention provides a bottom-hole impact-rotation stepping combined unloading rock-breaking efficient drilling system and a method thereof. In the present invention, a rotational impact assembly is disposed to convey a rotational power and a drilling axial high frequency impact force to a drill bit. The drill bit of the drilling system includes an external annular drill bit and an internal central drill bit which are disposed as an inner-concave and outer-convex stepped shape to achieve stress unloading of a bottom hole central part so as to release a geo-stress and reduce a rock drilling resistance. Further, in the present invention, the extendable disposal of the internal central drill bit relative to the external annular drill bit achieves stepping rock breaking as well as automatic distribution and regulation of impact energy. With the above multiple disposals favorable for improving the rock-breaking efficiency, the further improvement of the rock-breaking efficiency is achieved and protection is also provided for the bottom hole drilling tool.

SUMMARY

In order to overcome the above defects of the prior arts, the present invention provides a bottom-hole impact-rotation stepping combined unloading rock-breaking efficient drilling system and a method thereof.

In order to achieve the above purpose, the present invention adopts the following technical solution.

Provided is a bottom-hole impact-rotation stepping combined unloading rock-breaking efficient drilling system, including a cylindrically-structured housing; wherein a drive assembly, a universal joint, a transmission shaft and a rotational impact assembly sequentially connected along an axial direction are disposed in the housing; and an end of the rotational impact assembly is provided with a drill bit.

An outer wall surface of the transmission shaft and an inner wall surface of the housing are rotatably connected.

The rotational impact assembly includes a rotational transmission assembly for conveying a rotational power to the drill bit and an impact assembly for providing a high frequency axial impact power to the drill bit; an end of the rotational transmission assembly is connected with the transmission shaft and the other end is connected with the drill bit; when the rotational transmission assembly rotates along with the transmission shaft, the impact assembly applies a high frequency impact force along a drilling axial direction to the rotational transmission assembly.

An annular drill bit is disposed at an outer end of a drill bit body of the drill bit; a central drill bit is slidably disposed on an inner ring end surface of the annular drill bit; a drill bit inner cavity is disposed inside the drill bit, and a force applying assembly for axially pressing out the central drill bit outwardly is disposed inside the drill bit inner cavity; an inwardly-recessed cylindrical region is formed between a head end of the annular drill bit and a head end of the central drill bit.

Preferably, the rotational transmission assembly and the transmission shaft are coaxially disposed and an inner wall surface of one end of the rotational transmission assembly and an outer wall surface of the transmission shaft are axially and slidably connected, the other end of the rotational transmission assembly is connected with the drill bit; a annular space is formed between a middle portion of the rotational transmission assembly and the housing.

The impact assembly includes an impact ring located inside the annular space, and an outer wall surface of the impact ring and an inner wall surface of the housing are axially and slidably connected.

One circle of first impact ratchets are uniformly disposed circumferentially on an end surface of the impact ring facing toward the drill bit; a plurality of impact springs are uniformly disposed circumferentially on an end surface of the impact ring away from the drill bit, and the other ends of the impact springs are connected with the housing.

Second impact ratchets cooperating with the first impact ratchets are disposed on an end surface of the rotational transmission assembly facing toward the impact ring.

Preferably, the end surface of the impact ring provided with the first impact ratchets is provided with a first impact portion.

The end surface of the rotational transmission assembly provided with the second impact ratchets is provided with a second impact portion capable of cooperating with the first impact portion.

During a process of rotation of the rotational transmission assembly along with the transmission shaft, when an end surface of the first impact portion of the impact ring and an end surface of the second impact portion of the rotational transmission assembly are mutually attached, ratchet tops of the first impact ratchets do not reach ratchet roots of the second impact ratchets and ratchet tops of the second impact ratchets do not reach ratchet roots of the first impact ratchets.

Preferably, the rotational transmission assembly includes a rotational transmission shaft and an impact head.

The rotational transmission shaft and the transmission shaft are coaxially disposed and an end of the rotational transmission shaft and the outer wall surface of the transmission shaft are axially and slidably connected, the other end of the rotational transmission shaft and an end of the impact head are coaxially fixedly connected, and the other end of the impact head is connected with the drill bit.

The second impact portion and the second impact ratchets are disposed on an end surface of the impact head facing toward the impact ring.

Preferably, a sealing ring is disposed between an outer end surface of the impact head and an inner end surface of the housing.

Preferably, the force applying assembly includes a stepping force transmission body disposed inside the drill bit inner cavity; the stepping force transmission body and the drill bit inner cavity are axially and slidably connected; an outer end of the stepping force transmission body and the central drill bit are connected, an inner end of the stepping force transmission body and the stepping spring are connected, and the other end of the stepping spring and an inner end surface of the drill bit inner cavity are fixedly connected.

The drill bit body of the drill bit is provided with a nozzle flow channel and a central drill bit cuttings-discharge flow channel, and the nozzle flow channel is in communication with the drill bit inner cavity.

Preferably, the drive assembly includes a stator and a rotor; the stator is fixedly disposed on the inner end surface of the housing, and the rotor is disposed inside the stator.

Preferably, a universal flow-through cavity is formed between the universal joint and the housing, and the universal flow-through cavity is in communication with a flow-through cavity between the stator and the rotor.

a transmission flow-through cavity axially communicated are disposed in middle portions of the transmission shaft and the rotational transmission assembly; the transmission flow-through cavity is in communication with the drill bit inner cavity.

An end of the universal joint is provided with a universal shaft communication hole for communicating the universal flow-through cavity and the transmission flow-through cavity.

Preferably, rotatable connection between the outer wall surface of the transmission shaft and the inner wall surface of the housing is performed through a thrust bearing.

Both ends of the thrust bearing are further provided with a TC bearing, an inner ring of the TC bearing is connected with the outer wall surface of the transmission shaft, and an outer ring of the TC bearing is connected with the inner wall surface of the housing.

The present invention further provides a bottom-hole impact-rotation stepping combined unloading rock-breaking efficient drilling method.

The drilling method is performed based on the bottom-hole impact-rotation stepping combined unloading rock-breaking efficient drilling system and includes the following steps:

1) a drilling fluid is pumped into the drive assembly which converts a pressure energy of the drilling fluid into a rotational mechanical energy of the rotor which is conveyed to the drill bit through the universal joint, the transmission shaft and the rotational transmission assembly;
2) firstly the annular drill bit contacts the bottom hole to break the rocks at the outer ring of the drill bit under the action of a drilling pressure torque; during a rotation process of the rotational transmission assembly, under the action of the reverse thrust of the bottom hole, the impact assembly applies a high frequency impact force along a drilling axial direction to the rotational transmission assembly, so as to impact the external annular drill bit and enable the external annular drill bit to achieve impact-rotation drilling;
3) along with progress of rock-breaking of the annular drill bit, a rock pillar is formed in the inwardly-recessed cylindrical region of the central drill bit to effectively release the bottom hole stress;
4) after the central drill bit contacts the bottom hole, when the external annular drill bit receives impact, the external annular drill bit breaks rocks at high speed, where the stepping spring is compressed for energy storage to collect rock-breaking energy for the central drill bit, and at this time, the central drill bit breaks rocks at low speed or does not break rocks; when the external annular drill bit receives no impact, the external annular drill bit slows down rock-breaking or stops breaking rocks, the stepping spring extends to provide a rock-breaking power for the central drill bit to enable the central drill bit to break rocks at fast speed, so as to achieve stepping breaking for the bottom hole rocks;
5) during a process of impact-rotation drilling, bottom hole unloading, and stepping rock breaking, the nozzle flow channel sprays the drilling fluid to clean the drilling bit and carry rock cuttings to the ground through the central drill bit cuttings-discharge flow channel.

The present invention has the following beneficial effects.

(1) In the present invention, with entire structural disposal, stepping rock-breaking, bottom hole unloading and impact-rotation drilling can be achieved at the same time, greatly increasing the rock-breaking drilling efficiency, which is described as follows:

with the external annular drill bit and the internal central drill bit disposed as an inner-concave and outer-convex stepped shape, stress unloading of a bottom hole central part can be achieved so as to release a geo-stress and reduce a rock drilling resistance;

with disposal of extendable central drill bit and the stepping springs, stepping rock-breaking is achieved in cooperation with the external annular drill bit, and impact energy can be automatically distributed and regulated;

when the rotational transmission assembly drives the drill bit to rotate along with the transmission shaft, the impact assembly applies a high frequency impact force for along a drilling axial direction to the rotational transmission assembly, so as to achieve impacting on the external annular drill bit.

(2) The first impact portion and the second impact portion are disposed in the present invention. When the end surface of the first impact portion of the impact ring and the end surface of the second impact portion of the rotational transmission assembly are mutually attached, the corresponding ratchet tops of the first impact ratchets and the second impact ratchets do not reach corresponding ratchet roots, that is, when the impact ring impacts the rotational transmission assembly, the ratchet tops of the first impact ratchets do not come in impact contact with the ratchet roots of the second impact ratchets and the ratchet tops of the second impact ratchets do not come in impact contact with the ratchet roots of the first impact ratchets, thereby reducing the damage rate of the first impact ratchets and the second impact ratchets and increasing the service life.

BRIEF DESCRIPTIONS OF THE DRAWINGS

The accompanying drawing forming a part of the present invention is used to provide further understanding of the present invention. The exemplary embodiments and its descriptions of the present invention are used to explain the present invention rather than constitute limitation to the present invention.

Figure 1:
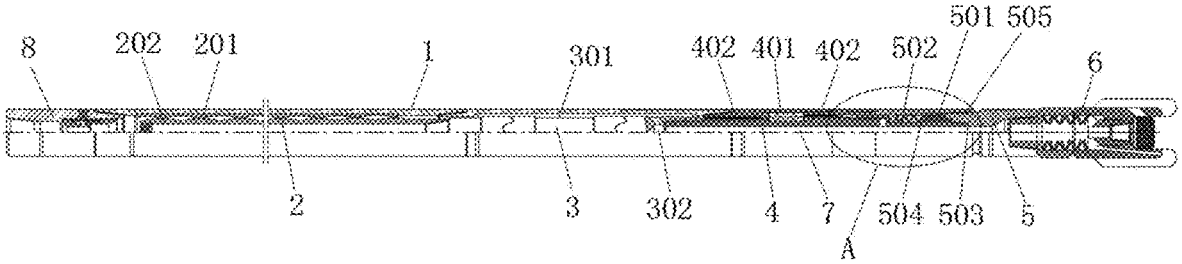
FIG. 1 is a structural schematic diagram illustrating a bottom-hole impact-rotation stepping combined unloading rock-breaking efficient drilling system of the present invention.

The numerals of the drawings are described below:

1—housing;

2—drive assembly, 201—stator, 202—rotor;

3—universal joint, 301—universal flow-through cavity, 302—universal shaft communication hole;

4—transmission shaft, 401—thrust bearing, 402—TC bearing;

5—rotational impact assembly, 501—impact ring, 5011—impact slide key, 5012—first impact portion, 5013—first impact ratchet, 502—impact spring, 503—impact head, 5031—second impact portion, 5032—second impact ratchet, 504—rotational transmission shaft, 505—sealing ring;

6—drill bit, 601—annular drill bit, 602—central drill bit, 603—drill bit inner cavity, 604—inwardly-recessed cylindrical region, 605—stepping force transmission body, 606—stepping spring, 607—nozzle flow channel, 608—central drill bit cuttings-discharge flow channel;

7—transmission flow-through cavity;

8—bypass valve.

DETAILED DESCRIPTIONS OF EMBODIMENTS

It should be pointed out that the following detailed descriptions are only illustrative and intended to provide further descriptions for the present invention. Unless otherwise stated, all technical and scientific terms used herein have the same meanings as persons of ordinary skills in the art can generally understand.

It is to be noted that terms used herein are used for describing specific embodiments rather than limit the exemplary embodiments of the present invention. As used herein, unless otherwise stated in the context, singular forms include plural forms. Further, it should be understood that when the terms "include" and/or "comprise" are used in the descriptions, they indicate presence of features, steps, operations, devices, assemblies and/or combinations thereof.

In the present invention, orientations or positional relationships indicated by terms such as "upper", "lower", "bottom" and "top" are based on the orientations and positional relationship shown in the drawings and are only relational terms determined to facilitate describing structural relationship of each component or element in the present invention rather than specifically refer to any component or element in the present invention and shall not be understood limiting of the present invention.

In the present invention, the terms such as "connect" and "coupling" shall be understood in a broad sense to indicate a fixed connection or integral connection or detachable connection or direct connection or connection through intermediate medium. Those skilled in the art may determine the specific meanings of the above terms based on specific situations, which are not understood as limiting of the present invention.

The present invention will be further described below in combination with the accompanying drawings and the embodiments.

Embodiment 1

As shown in FIG. 1, there is provided a bottom-hole impact-rotation stepping combined unloading rock-breaking efficient drilling system, including: a cylindrically-structured housing 1; where a drive assembly 2, a universal joint 3, a transmission shaft 4 and a rotational impact assembly 5 sequentially connected along an axial direction are disposed in the housing 1; an end of the rotational impact assembly 5 is provided with a drill bit 6; a rotational power of the drive assembly 2 is conveyed to the transmission shaft 4 through the universal joint 3, and the transmission shaft 4 then conveys the rotational power to the rotational impact assembly 5 which then conveys the rotational power to the drill bit 6. Further, in an actual production process, the housing 1 may be manufactured in sections based on actual situations to facilitate mounting of the drive assembly 2, the universal joint 3, the transmission shaft 4 and the rotational impact assembly 5.

An outer wall surface of the transmission shaft 4 and an inner wall surface of the housing 1 are rotatably connected.

The rotational impact assembly 5 includes a rotational transmission assembly for conveying a rotational power to the drill bit 6 and an impact assembly for providing a high frequency axial impact power to the drill bit 6; an end of the rotational transmission assembly is connected with the transmission shaft 4 and the other end is connected with the drill bit 6; when the rotational transmission assembly rotates along with the transmission shaft 4, the impact assembly applies a high frequency impact force along a drilling axial direction to the rotational transmission assembly, thereby achieving impact-rotation drilling of the drill bit.

Figure 3:
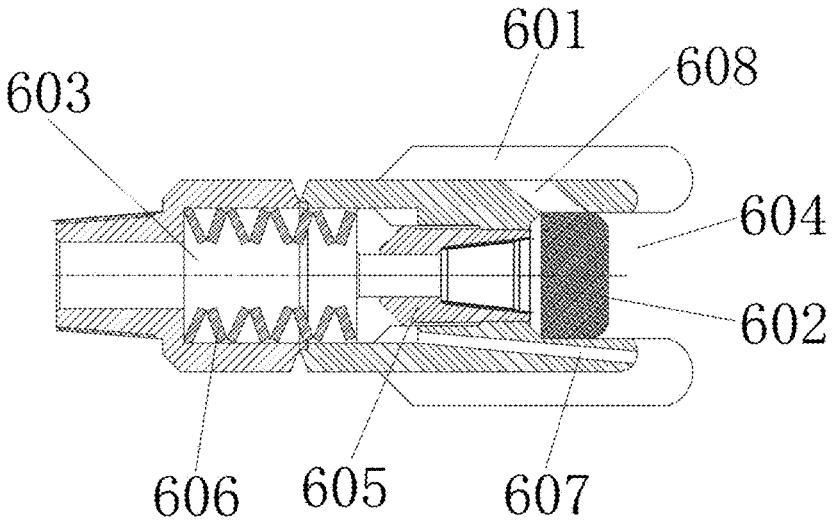
FIG. 3 is a structural schematic diagram illustrating a drill bit of the present invention.

As shown in FIG. 3, an annular drill bit 601 is disposed at an outer end of a drill bit body of the drill bit 6; a central drill bit 602 is slidably disposed on an inner ring end surface of the annular drill bit 601; a drill bit inner cavity 603 is disposed inside the drill bit 6, and a force applying assembly for axially pressing out the central drill bit 602 outwardly is disposed inside the drill bit inner cavity 603; an inwardly-recessed cylindrical region 604 is formed between a head end of the annular drill bit 601 and a head end of the central drill bit 602. The annular drill bit 601 and the central drill bit 602 both are provided with cutting teeth.

When a formation with high geostress is drilled, the cutting teeth of the annular drill bit 601 firstly breaks the rocks at the outer ring of the drill bit and the broken rocks are discharged along a drilling fluid sprayed out of a nozzle.

Since the central drill bit 602 has a small height, an inwardly-recessed cylindrical region is formed in an end surface region of the central drill bit 602 to form a inner-concave and outer-convex stepped structure. When the formation is drilled, a "rock pillar" may be formed in the inwardly-recessed cylindrical region. When a region with high geostress is drilled, the rocks have poor drillability. The "rock pillar" formed by such stepped structure in drilling process effectively reduces and even eliminates the influence of the geostress on the rock drillability, thus greatly increasing the rock drillability. The region of the "rock pillar" forms a stress unloading region which can effectively prevent occurrence of "hollowing". The central drill bit 602 breaks the middle "rock pillar", and the rock cuttings formed hereby are carried and cleaned by the drilling fluid sprayed from the nozzle in the nozzle flow channel 607 and then discharged through the central drill bit cuttings-discharge flow channel 608.

Figure 2:
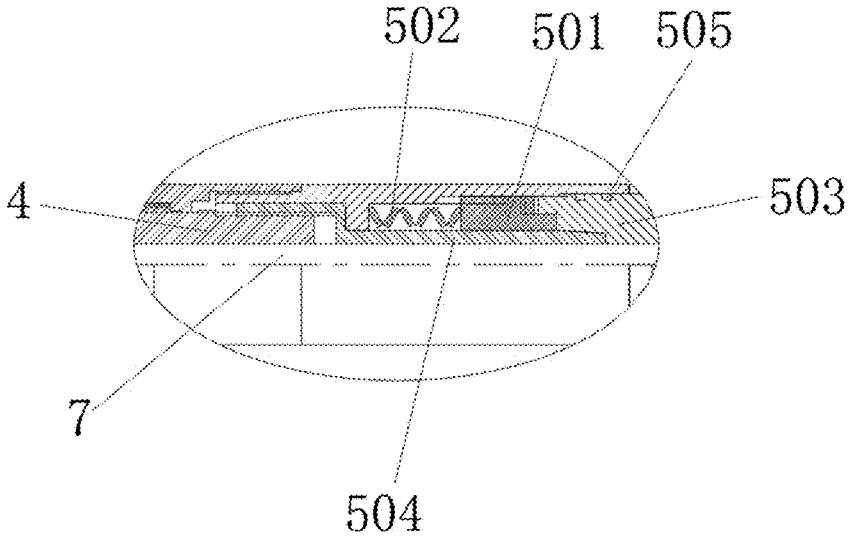
FIG. 2 is a partially-enlarged view of the position A in FIG. 1.

Preferably, as shown in FIG. 2, the rotational transmission assembly and the transmission shaft 4 are coaxially disposed and an inner wall surface of one end of the rotational transmission assembly and an outer wall surface of the transmission shaft 4 are axially and slidably connected, and the other end of the rotational transmission assembly is connected with the drill bit 6, such that the rotational power is conveyed among the transmission shaft 4, the rotational transmission assembly 5 and the drill bit 6. Specifically, a plurality of first slide key grooves are uniformly disposed circumferentially on an end of the outer wall surface of the transmission shaft 4 and extend along an axial direction of the transmission shaft 4, whereas a plurality of first slide keys axially and slidably cooperating with the first slide key grooves are disposed circumferentially at a corresponding end of the inner wall surface of the rotational transmission assembly; a annular space is formed between a middle portion of the rotational transmission assembly and the housing 1.

The impact assembly is located inside the annular space.

Figure 4:
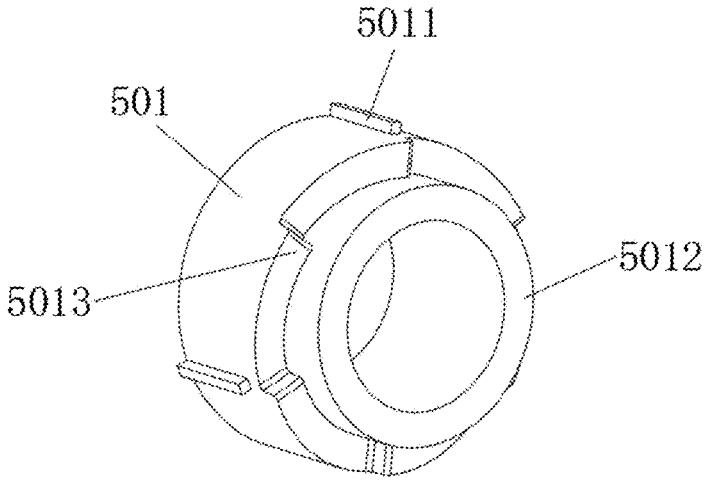
FIG. 4 is a structural schematic diagram illustrating an impact ring of the present invention.

The impact assembly includes an impact ring 501 located inside the annular space, and an outer wall surface of the impact ring 501 and an inner wall surface of the housing are axially and slidably connected. Specifically, as shown in FIG. 4, a plurality of impact slide keys 5011 are uniformly disposed circumferentially on the outer wall surface of the impact ring 501 and extend along the axial direction of the transmission shaft 4, whereas a plurality of impact slide key grooves axially and slidably cooperating with the impact slide keys 5011 are disposed circumferentially at a corresponding position of the inner wall surface of the housing 1.

One circle of first impact ratchets 5013 are uniformly disposed circumferentially on an end surface of the impact ring 501 facing toward the drill bit 6; a plurality of impact springs 502 are uniformly disposed circumferentially on an end surface of the impact ring 501 away from the drill bit 6, and the other ends of the impact springs 502 are connected with the housing 1. Specifically, the elastic direction of the impact spring 502 is parallel to the axial direction of the transmission shaft 4.

Figure 5:
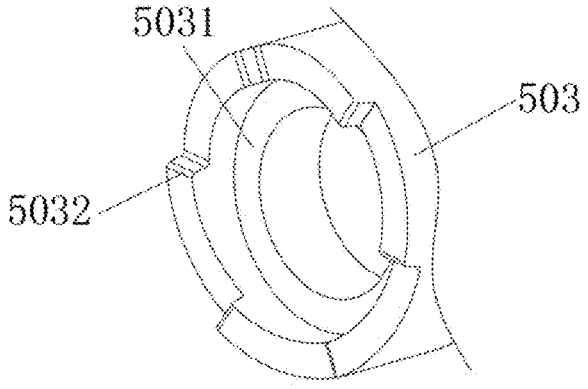
FIG. 5 is a structural schematic diagram illustrating second impact ratchets and an annular concave surface of an impact head according to the present invention.

As shown in FIG. 5, second impact ratchets 5032 cooperating with the first impact ratchets 5013 are disposed on an end surface of the rotational transmission assembly facing toward the impact ring 501.

When the rotational transmission assembly rotates along with the transmission shaft 4, the cooperation of the first impact ratchets 5013 and the second impact ratchets 5032 enables the impact ring 501 to generate an axial periodic displacement change, so as to drive the impact springs 502 to generate periodic compression and release, thus achieving high frequency axial impact on the drill bit 6.

Preferably, the end surface of the impact ring 501 provided with the first impact ratchets 5013 is provided with a first impact portion 5012.

The end surface of the rotational transmission assembly provided with the second impact ratchets 5032 is provided with a second impact portion 5031 capable of cooperating with the first impact portion 5012.

Figure 6:
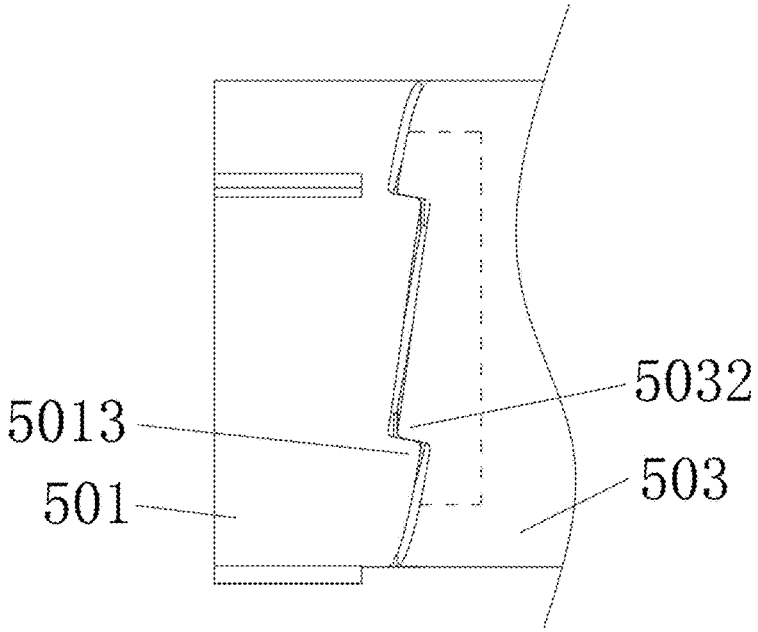
FIG. 6 is a schematic diagram illustrating cooperation of first impact ratchets and second impact ratchets when an annular convex block end surface and an annular groove end surface according to the present invention.

As shown in FIG. 6, during a process of rotation of the rotational transmission assembly along with the transmission shaft 4, when an end surface of the first impact portion 5012 of the impact ring 501 and an end surface of the second impact portion 5031 of the rotational transmission assembly are mutually attached, ratchet tops of the first impact ratchets 5013 do not reach ratchet roots of the second impact ratchets 5032 and ratchet tops of the second impact ratchets 5032 do not reach ratchet roots of the first impact ratchets 5013. In the present invention, the first impact ratchets 5013 and the second impact ratchets 5032 are matched in ratchet contour.

The first impact portion 5012 and the second impact portion 5031 are a mutually-cooperating annular boss-annular groove disposal. When the first impact portion 5012 is an annular boss, the second impact portion 5031 is an annular groove; when the first impact portion 5012 is an annular groove, the second impact portion 5031 is an annular boss.

The first impact ratchets 5013 may be located at a radial outer side of the first impact portion 5012 or located at a radial inner side of the first impact portion 5012.

The second impact ratchets 5032 may be located at a radial outer side of the second impact portion 5031 or located at a radial inner side of the second impact portion 5031.

When the first impact portion 5012 is an annular boss and the first impact ratchets 5013 are located at the radial outer side of the annular boss, a positional relationship between the first impact ratchets 5013 and the annular boss is as shown in FIG. 4.

When the second impact portion 5031 is an annular groove and the second impact ratchets 5032 are located at the radial outer side of the annular groove, a positional relationship between the second impact ratchets 5032 and the annular groove is as shown in FIG. 5.

Since a length the annular boss protrudes is greater than a length the annular groove concaves, when an end surface of the annular boss and an end surface of the annular groove are mutually attached, the corresponding ratchet tops of the first impact ratchets 5013 and the second impact ratchets 5032 do not contact the corresponding ratchet roots.

During drilling, the drive assembly 2 conveys the rotational power to the drill bit 6 through the universal joint 3, the transmission shaft 4 and the rotational transmission assembly so as to provide a rotational drilling power to the drill bit 6. Further, when the rotational transmission assembly rotates (in this process, slidable cooperation between the impact slide keys 5011 on the impact ring 501 and the impact slide key grooves on the housing 1 performs circumferential limitation for the impact ring 501 so as to immobilize the impact ring 501), under the action of the reverse thrust of the bottom hole, ratchet top aligning-staggering may be appear cyclically between the second impact ratchets 5032 and the first impact ratchets 5013, such that the impact ring 501 generates an axial periodic displacement change, so as to drive the impact springs 502 to generate periodic compression and release. When the first impact ratchets 5013 and the second impact ratchets 5032 change from ratchet top aligning to staggering abruptly, the impact springs 502 spring out to release energy and the end surface of the first impact portion 5012 of the impact ring 501 impacts the end surface of the second impact portion 5031 of the rotational transmission assembly. In this impact process, the corresponding ratchet tops of the first impact ratchets 5013 and the second impact ratchets 5032 do not reach the corresponding ratchet roots. The rotational transmission assembly continues rotating a tiny angle to enable side surfaces of the first impact ratchets 5013 to be in surface-surface contact with corresponding surfaces of the second impact ratchets 5032. The rotational transmission assembly continues rotating and the relative movement is performed between the first impact ratchets 5013 and the second impact ratchets 5032. Such cycle is repeated as above. A number of reciprocating impacts of one circle of rotation is related to a number of ratchets on the impact ring 501. By designing the drilling speed of the drive assembly 2 and the number of ratchets on the impact ring 501, the impact frequency can be controlled. The high frequency impact force generated by the impact assembly is conveyed to the drill bit 6 through the rotational transmission assembly so as to achieve high frequency impact on the bottom hole of the drill bit 6, thus achieving impact-rotation efficient drilling for the bottom hole.

Furthermore, in the present invention, the first impact portion 5012 and the second impact portion 5031 are disposed. When the end surface of the first impact portion 5012 of the impact ring 501 and the end surface of the second impact portion 5031 of the rotational transmission assembly are mutually attached, the corresponding ratchet tops of the first impact ratchets 5013 and the second impact ratchets 5032 do not reach the corresponding ratchet roots, that is, when the impact ring 501 impacts the rotational transmission assembly, the ratchet tops of the first impact ratchets 5013 do not come in impact contact with the ratchet roots of the second impact ratchets 5032 and the ratchet tops of the second impact ratchets 5032 do not come in impact contact with the ratchet roots of the first impact ratchets 5013, thereby reducing the damage rate of the first impact ratchets 5013 and the second impact ratchets 5032 and increasing the service life.

Preferably, the rotational transmission assembly includes a rotational transmission shaft 504 and an impact head 503.

The rotational transmission shaft 504 and the transmission shaft 4 are coaxially disposed and an end of the rotational transmission shaft 504 and the outer wall surface of the transmission shaft 4 are axially and slidably connected, that is, the rotational transmission shaft 504 can rotate along with the transmission shaft 4 and can perform axial slide during the rotation. The other end of the rotational transmission shaft 504 and an end of the impact head 503 are coaxially and fixedly connected, and the other end of the impact head 503 is connected with the drill bit 6.

The second impact portion 5031 and the second impact ratchets 5032 are disposed on an end surface of the impact head 503 facing toward the impact ring 501.

Preferably, a sealing ring 505 is disposed between an outer end surface of the impact head 503 and the inner end surface of the housing 1.

Preferably, as shown in FIG. 3, the force applying assembly includes a stepping force transmission body 605 disposed inside the drill bit inner cavity 603; the stepping force transmission body 605 and the drill bit inner cavity 603 are axially and slidably connected. Specifically, a plurality of stepping slide keys are uniformly disposed circumferentially on an outer wall surface of the stepping force transmission body 605 and extend along an axial direction of the transmission shaft 4, whereas a plurality of stepping slide key grooves in axial slidable cooperation with the stepping slide keys are disposed circumferentially at the corresponding position of the wall surface of the drill bit inner cavity 603; an outer end of the stepping force transmission body 605 is connected with the central drill bit 602, an inner end of the stepping force transmission body 605 is connected with the stepping spring 606, and the other end of the stepping spring 606 is fixedly connected with an inner end surface of the drill bit inner cavity 603.

The drill bit body of the drill bit 6 is provided with a nozzle flow channel 607 and a central drill bit cuttings-discharge flow channel 608; a nozzle is disposed inside the nozzle flow channel 607 to provide a drilling fluid, and the central drill bit cuttings-discharge flow channel 608 is used to discharge rock cuttings produced by the central drill bit 602 during drilling into an annular space. The nozzle flow channel 607 is in communication with the drill bit inner cavity 603.

In the present invention, with disposal of the stepping force transmission body 605 and the stepping spring 606, bottom hole pressure unloading is achieved in the inwardly-recessed central drill bit 602 and the central drill bit 602 is enabled to break the "rock pillars": after the central drill bit 602 also contacts the bottom hole, when the external annular drill bit 601 receives impact, the external annular drill bit 601 breaks rocks at high speed and the stepping spring 606 is compressed for energy storage to provide a rock-breaking energy for the central drill bit 602. At this time, the central drill bit 602 breaks rocks at low speed or does not break rocks; when the external annular drill bit 601 receives no impact, the external annular drill bit 601 slows down rock-breaking or stops breaking rocks, the stepping spring 606 extends to provide a rock-breaking power for the central drill bit 602 to enable the central drill bit 602 to break rocks at fast speed, so as to achieve stepping breaking for the bottom hole rocks.

Preferably, the drive assembly 2 includes a stator 201 and a rotor 202; the stator 201 is fixedly disposed on the inner end surface of the housing 1, and the rotor 202 is disposed inside the stator 201; an end of the rotor 202 is connected with the universal joint 3 and the other end of the universal joint 3 is connected with the transmission shaft 4.

Preferably, a universal flow-through cavity 301 is formed between the universal joint 3 and the housing 1, and the universal flow-through cavity 301 is in communication with a flow-through cavity between the stator 201 and the rotor 202.

A transmission flow-through cavity 7 axially communicated are disposed in middle portions of the transmission shaft 4 and the rotational transmission assembly; the transmission flow-through cavity 7 is in communication with the drill bit inner cavity 603.

An end of the universal joint 3 is provided with a universal shaft communication hole 302 for communicating the universal flow-through cavity 301 and the transmission flow-through cavity 7.

Preferably, rotatable connection between the outer wall surface of the transmission shaft 4 and the inner wall surface of the housing 1 is performed through a thrust bearing 401.

Both ends of the thrust bearing 401 are further provided with a TC bearing 402, an inner ring of the TC bearing 402 is connected with the outer wall surface of the transmission shaft 4, and an outer ring of the TC bearing 402 is connected with the inner wall surface of the housing 1.

The disposal of the TC bearing 402 enables, on the one hand, the rotatable connection between the transmission shaft 4 and the housing 1 to be more stable and on the other hand, performs axial positioning for the thrust bearing 401.

Specifically, an end of the housing 1 away from the drill bit 6 is provided with a bypass valve 8 in communication with an inlet of the drive assembly 2.

Embodiment 2

Provided is a bottom-hole impact-rotation stepping combined unloading rock-breaking efficient drilling method, which is performed based on the bottom-hole impact-rotation stepping combined unloading rock-breaking efficient drilling system in the embodiment 1. The method includes the following steps.

1) a drilling fluid is pumped into the drive assembly 2 which converts a pressure energy of the drilling fluid into a rotational mechanical energy of the rotor 202 which is conveyed to the drill bit 6 through the universal joint 3, the transmission shaft 4 and the rotational transmission assembly;
2) firstly the annular drill bit 601 contacts the bottom hole to break the rocks at the outer ring of the drill bit 6 under the action of a drilling pressure torque; during a rotation process of the rotational transmission assembly, under the action of the reverse thrust of the bottom hole, the impact assembly applies a high frequency impact force along a drilling axial direction to the rotational transmission assembly, so as to impact the external annular drill bit 601 and enable the external annular drill bit 601 to achieve impact-rotation drilling; where the high frequency impact is achieved based on the following principle: when the rotational transmission assembly rotates along with the transmission shaft 4, the cooperation of the first impact ratchets 5013 and the second impact ratchets 5032 enables the impact ring 501 to generate an axial periodic displacement change, so as to drive the impact springs 502 to generate periodic compression and release, thus achieving high frequency axial impact on the drill bit 6.
3) along with progress of rock-breaking of the annular drill bit 601, a rock pillar is formed in the inwardly-recessed cylindrical region 604 of the central drill bit 602 to effectively release the bottom hole stress;
4) after the central drill bit 602 contacts the bottom hole, when the external annular drill bit 601 receives impact, the external annular drill bit 601 breaks rocks at high speed, where the stepping spring 606 is compressed for energy storage to collect rock-breaking energy for the central drill bit 602, and at this time, the central drill bit 602 breaks rocks at low speed or does not break rocks (in this process, the central drill bit 602 rotates along with the annular drill bit 601 but the central drill bit 602 breaks rocks at slow speed); when the external annular drill bit 601 receives no impact, the external annular drill bit 601 slows down rock-breaking or stops breaking rocks (at this time, the annular drill bit 601 still rotates but breaks rocks at lower speed), the stepping spring 606 extends to provide a rock-breaking power for the central drill bit 602 to enable the central drill bit 602 to break rocks at fast speed, so as to achieve stepping breaking for the bottom hole rocks;
5) during a process of impact-rotation drilling, bottom hole unloading, and stepping rock breaking, the nozzle flow channel 607 sprays the drilling fluid to clean the drilling bit and carry rock cuttings to the ground through the central drill bit cuttings-discharge flow channel 608.

In the present invention, with the entire structural disposal, stepping rock breaking, bottom hole unloading and impact-rotation drilling can be achieved at the same time to greatly increase the rock-breaking drilling efficiency; the rotational impact assembly 2 disposed herein has the advantages of high impact frequency, large impact and long service life; the present invention is applicable to wide scope and can be used in various wells such as straight wells, directional wells and the like; With the present invention, in a drilling process, the operations are completely same as the conventional drilling without special requirements for ground facilities and drilling strings, thus helping its promotion and application.

Although descriptions are made to the specific embodiments of the present invention as mentioned above, the descriptions are not intended to limit the present invention. Those skilled in the art should understand that various changes and modifications made based on the technical solutions of the present invention without making creative work shall fall within the scope of protection of the present invention.

What is claimed is:

1. A bottom-hole impact-rotation stepping combined unloading rock-breaking efficient drilling system, comprising: a cylindrically-structured housing; wherein a drive assembly, a universal joint, a transmission shaft and a rotational impact assembly sequentially connected along an axial direction are disposed in the housing; an end of the rotational impact assembly is provided with a drill bit;

an outer wall surface of the transmission shaft and an inner wall surface of the housing are rotatably connected;

the rotational impact assembly comprises a rotational transmission assembly for conveying a rotational power to the drill bit and an impact assembly for providing a high frequency axial impact power to the drill bit; an end of the rotational transmission assembly is connected with the transmission shaft and the other end is connected with the drill bit; when the rotational transmission assembly rotates along with the transmission shaft, the impact assembly applies a high frequency impact force along a drilling axial direction to the rotational transmission assembly;

an annular drill bit is disposed at an outer end of a drill bit body of the drill bit; a central drill bit is slidably disposed on an inner ring end surface of the annular drill bit; a drill bit inner cavity is disposed inside the drill bit, and a force applying assembly for axially pressing out the central drill bit outwardly is disposed inside the drill bit inner cavity; an inwardly-recessed cylindrical region is formed between a head end of the annular drill bit and a head end of the central drill bit;

the rotational transmission assembly and the transmission shaft are coaxially disposed and an inner wall surface of one end of the rotational transmission assembly and an outer wall surface of the transmission shaft are axially and slidably connected, the other end of the rotational transmission assembly is connected with the drill bit; an annular space is formed between a middle portion of the rotational transmission assembly and the housing;

the impact assembly comprises an impact ring located inside the annular space, and an outer wall surface of the impact ring and an inner wall surface of the housing are axially and slidably connected;

one circle of first impact ratchets are uniformly disposed circumferentially on an end surface of the impact ring facing toward the drill bit; a plurality of impact springs are uniformly disposed circumferentially on an end surface of the impact ring away from the drill bit, and the other ends of the impact springs are connected with the housing;

second impact ratchets cooperating with the first impact ratchets are disposed on an end surface of the rotational transmission assembly facing toward the impact ring;

the end surface of the impact ring provided with the first impact ratchets is provided with a first impact portion;

the end surface of the rotational transmission assembly provided with the second impact ratchets is provided with a second impact portion capable of cooperating with the first impact portion;

during a process of rotation of the rotational transmission assembly along with the transmission shaft, when an end surface of the first impact portion of the impact ring and an end surface of the second impact portion of the rotational transmission assembly are mutually attached, ratchet tops of the first impact ratchets do not reach ratchet roots of the second impact ratchets and ratchet tops of the second impact ratchets do not reach ratchet roots of the first impact ratchets.

2. The bottom-hole impact-rotation stepping combined unloading rock-breaking efficient drilling system of claim 1, wherein the rotational transmission assembly comprises a rotational transmission shaft and an impact head;

the rotational transmission shaft and the transmission shaft are coaxially disposed and an end of the rotational transmission shaft and the outer wall surface of the transmission shaft are axially and slidably connected, the other end of the rotational transmission shaft and an end of the impact head are coaxially fixedly connected, and the other end of the impact head is connected with the drill bit;

the second impact portion and the second impact ratchets are disposed on an end surface of the impact head facing toward the impact ring.

3. The bottom-hole impact-rotation stepping combined unloading rock-breaking efficient drilling system of claim 2, wherein a sealing ring is disposed between an outer end surface of the impact head and an inner end surface of the housing.

4. The bottom-hole impact-rotation stepping combined unloading rock-breaking efficient drilling system of claim 1, wherein the force applying assembly comprises a stepping force transmission body disposed inside the drill bit inner cavity; the stepping force transmission body and the drill bit inner cavity are axially and slidably connected; an outer end of the stepping force transmission body and the central drill bit are connected, an inner end of the stepping force transmission body and a stepping spring are connected, and the other end of the stepping spring and an inner end surface of the drill bit inner cavity are fixedly connected;

the drill bit body of the drill bit is provided with a nozzle flow channel and a central drill bit cuttings-discharge flow channel, and the nozzle flow channel is in communication with the drill bit inner cavity.

5. The bottom-hole impact-rotation stepping combined unloading rock-breaking efficient drilling system of claim 1, wherein the drive assembly comprises a stator and a rotor; the stator is fixedly disposed on the inner end surface of the housing, and the rotor is disposed inside the stator.

6. The bottom-hole impact-rotation stepping combined unloading rock-breaking efficient drilling system of claim 5, wherein a universal flow-through cavity is formed between the universal joint and the housing, and the universal flow-through cavity is in communication with a flow-through cavity between the stator and the rotor;

a transmission flow-through cavity axially communicated are disposed in middle portions of the transmission shaft and the rotational transmission assembly; the transmission flow-through cavity is in communication with the drill bit inner cavity;

an end of the universal joint is provided with a universal shaft communication hole for communicating the universal flow-through cavity and the transmission flow-through cavity.

7. The bottom-hole impact-rotation stepping combined unloading rock-breaking efficient drilling system of claim 1, wherein rotatable connection between the outer wall surface of the transmission shaft and the inner wall surface of the housing is performed through a thrust bearing;

both ends of the thrust bearing are further provided with a TC bearing, an inner ring of the TC bearing is connected with the outer wall surface of the transmission shaft, and an outer ring of the TC bearing is connected with the inner wall surface of the housing.

8. A bottom-hole impact-rotation stepping combined unloading rock-breaking efficient drilling method, wherein the drilling method is performed based on the bottom-hole impact-rotation stepping combined unloading rock-breaking efficient drilling system according to claim 1 and comprises the following steps:

1) A drilling fluid is pumped into the drive assembly which converts a pressure energy of the drilling fluid into a rotational mechanical energy of a rotor which is conveyed to the drill bit through the universal joint, the transmission shaft and the rotational transmission assembly;

2) Firstly the annular drill bit contacts the bottom hole to break the rocks at the outer ring of the drill bit under the action of a drilling pressure torque; during a rotation process of the rotational transmission assembly, under the action of the reverse thrust of the bottom hole, the impact assembly applies a high frequency impact force along a drilling axial direction to the rotational transmission assembly, so as to impact the external annular drill bit and enable the external annular drill bit to achieve impact-rotation drilling;

3) Along with progress of rock-breaking of the annular drill bit, a rock pillar is formed in the inwardly-recessed cylindrical region of the central drill bit to effectively release the bottom hole stress;

4) After the central drill bit contacts the bottom hole, when the external annular drill bit receives impact, the external annular drill bit breaks rocks at high speed, where a stepping spring is compressed for energy storage to collect rock-breaking energy for the central drill bit, and at this time, the central drill bit breaks rocks at low speed or does not break rocks; when the external annular drill bit receives no impact, the external annular drill bit slows down rock-breaking or stops breaking rocks, the stepping spring extends to provide a rock-breaking power for the central drill bit to enable the central drill bit to break rocks at fast speed, so as to achieve stepping breaking for the bottom hole rocks;

5) During a process of impact-rotation drilling, bottom hole unloading, and stepping rock breaking, a nozzle flow channel sprays the drilling fluid to clean the drilling bit and carry rock cuttings to the ground through a central drill bit cutting discharge flow channel.

* * * * *